United States Patent [19]

Hiroi et al.

[11] Patent Number: 5,035,412

[45] Date of Patent: Jul. 30, 1991

[54] CONTROL METHOD FOR A SORTER

[75] Inventors: Masakazu Hiroi, Yokohama; Masataka Naito, Kawasaki; Kimiaki Hayakawa, Yokohama; Kenji Kobayashi, Tokyo; Mitsuhiro Mukasa, Kawasaki, all of Japan

[73] Assignee: Canon Kabushiki Kaisha, Tokyo, Japan

[21] Appl. No.: 304,489

[22] Filed: Feb. 1, 1989

[30] Foreign Application Priority Data

Feb. 3, 1988 [JP] Japan ..... 63-23126
Aug. 19, 1988 [JP] Japan ..... 63-207167

[51] Int. Cl.[5] ..... B42B 1/02

[52] U.S. Cl. ..... 270/053; 270/52; 270/58; 271/292; 271/294

[58] Field of Search ..... 270/37, 53, 58; 271/288, 292, 294

[56] References Cited

U.S. PATENT DOCUMENTS

| | | | |
|---|---|---|---|
| 3,944,207 | 3/1976 | Bains | 270/37 |
| 3,995,748 | 12/1976 | Looney | 270/53 |
| 4,361,393 | 11/1982 | Noto | 270/53 |
| 4,385,827 | 5/1983 | Naramore | 355/145 H |
| 4,444,491 | 4/1984 | Rinehart | 270/53 |
| 4,523,750 | 1/1985 | Hubler | 270/53 |

*Primary Examiner*—Edward K. Look
*Assistant Examiner*—Therese M. Newholm
*Attorney, Agent, or Firm*—Fitzpatrick, Cella, Harper & Scinto

[57] ABSTRACT

A method for controlling a sheet sorter wherein plural bins are sequentially moved to be faced to a sheet material inlet to sort the sheet materials onto the bins includes permitting sorting operation; and starting to reset the plural bins after the sheet materials are taken out of the bins.

19 Claims, 14 Drawing Sheets

CONTROL METHOD FOR A SORTER

FIELD OF THE INVENTION AND RELATED ART

The present invention relates to a control method for a sorter for sorting sheets or a control method for an image forming apparatus equipped with a sheet sorter. The sorter sorts sheet materials discharged from an image forming apparatus such as a copying machine and printer.

Usually, a movable bin type sorter, upon completion of the sorting operation corresponding to a series of copying operation, all the operations stop at the position wherein the last sheet is discharged. At this time, the bins are possibly not placed at the home position. Therefore, one of the following two systems has been used; the sorter itself includes a timer to automatically reset the bins to the home position a predetermined period after the stoppage; and the bins are reset to the home position in response to the next copy performing cycle.

However, the first system involves a problem that the bin unit can suddenly lower or rise while the operator is picking up the sheets from the bins. If it occurs, the operator can catch his or her hand between bins, or can drop the set of copy sheets which he or she is picking up.

In the second system wherein the bin unit is reset to the home position in response to the next copy signal, the next copy cycle operation can not start before the bin unit is reset to the home position after a copy button is depressed, with the result of additional loss time. When, for example, a 20 bin sorter is stopped at the 20th bin, a long loss time is required for the resetting movement of the bin unit through a distance corresponding to 20 bins.

SUMMARY OF THE INVENTION

Accordingly, it is a principal object of the present invention to provide a control method for a sheet sorter with reduced loss time and with good operativity.

According to an embodiment of the present invention, the control system is such that the bins are automatically reset in response to complete removal of the sheets from the bins. According to this control, the bin unit is automatically reset to the home position, and therefore, the loss time required for the bin unit to reset to the home position during the next copying cycle is eliminated, and in addition, the safety from the operator's standpoint is improved.

According to another embodiment of the present invention, a control method is such that when a signal for starting the next copying operation is produced during the resetting movement of the bin unit to a predetermined position, the speed of the resetting movement of the bin unit is increased. In this embodiment, the resetting period for the bin unit is reduced to assure quick start of the next operation, thus increasing the operational efficiency.

More particularly, in the first mentioned embodiment, after the sheet sorting operation is completed, and the sheets are picked out of the bins to such an extent that there is no sheet remaining on any bin, the bin unit is reset to the home position. During the movement of the bins to the home position, it is preferable to slowly move the bins so as not to threaten the operator, and therefore, the bin resetting speed is set relatively slow.

According to the second embodiment, however, the next copy start is instructed during the resetting movement, the resetting speed is increased, thus further reducing the loss time.

In such a sorter wherein the sheet reception by the bin can be started at the n-th bin when the number of sets of copy is n, the start of the next copying operation can be made quicker, thus improving the operational efficiency.

As for a method for solving the problems of the conventional system, the bin unit resetting operation is started in response to completion of the sorting operation or completion of the sorting and stapling operations, and the resetting operation is performed at a low speed. According to this method, the bin unit is reset before the next cycle, and therefore, there is no loss time, and since the resetting operation is slow, the safety for the operator can be assured.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
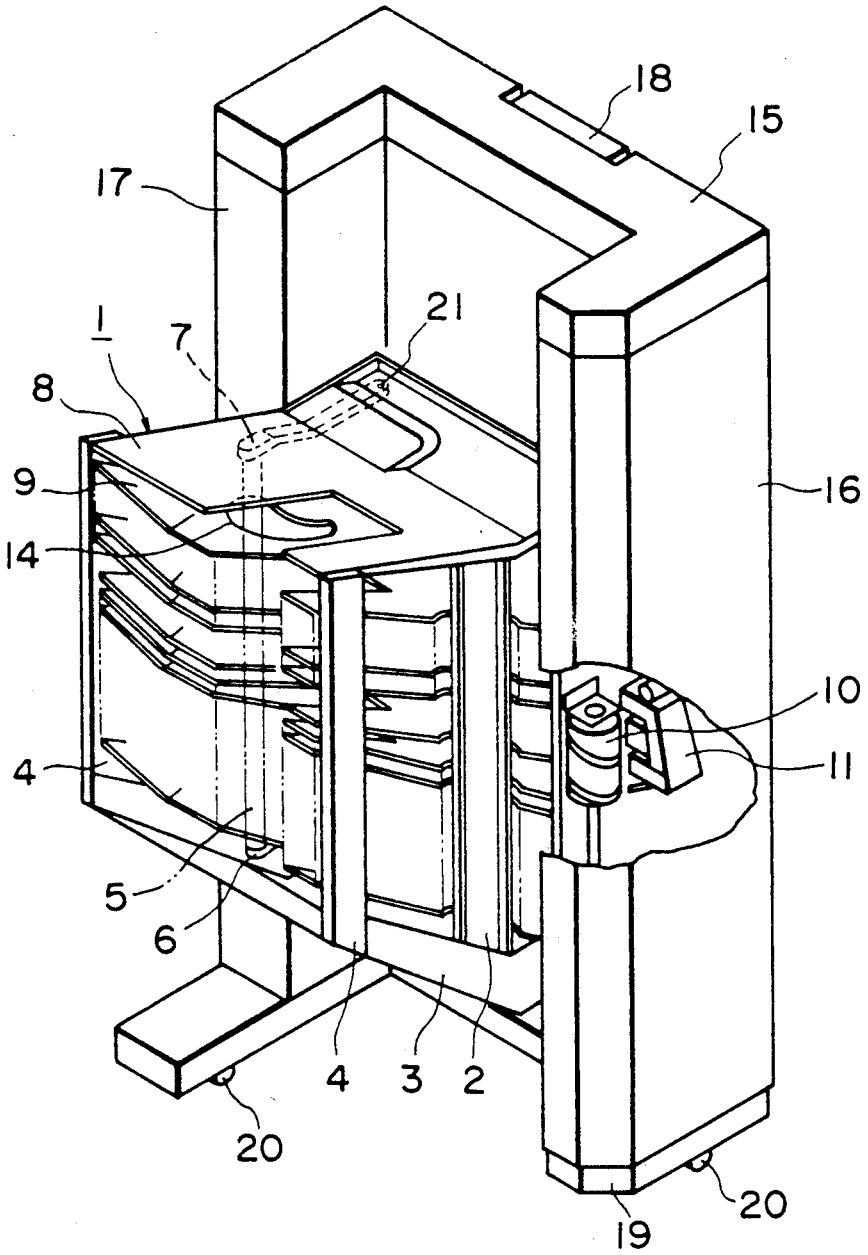
FIG. 1 is a perspective view of a sorter usable with the control method or device according to an embodiment of the present invention.

Referring to FIGS. 1-6, there is shown a system according to first embodiment of the present invention. The sorter shown 1 comprises a bin unit 1 including a plurality of bins, an alignment reference member 2 disposed between a frame 3 of the bin unit 1 and a top cover 8, a structural member 4 for constituting a bin unit 1 which is disposed at each of front and rear sides to support free ends of the bins 9 (left ends) at front and rear sides. The bins 9 have cut-away portions 14, through all of which an alignment rod 5 is extended. The bottom of the alignment rod 5 is supported by an arm 6 having a rotational center which is coaxial with a rotational center 21 of an arm 7 for supporting a top part of the alignment rod. The sorter further comprises a lead cam 10 for substantially vertically moving the bin unit (another lead cam at the rear side is not shown), a stapler unit 11, covers 15, 16 and 17, a grip 18, a bottom plate 19 and a caster 20.

Figure 2:
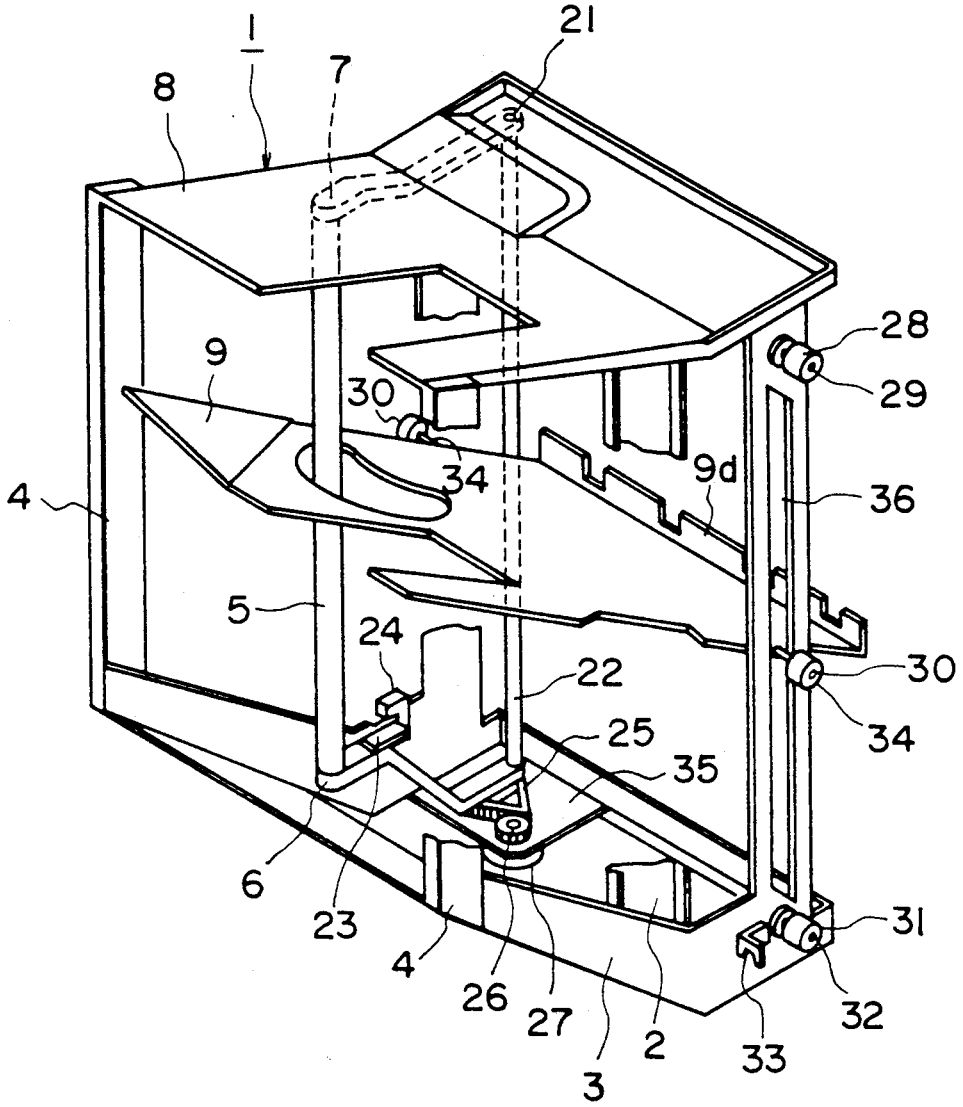
FIG. 2 is a perspective view of a bin unit.

Referring to FIG. 2 which shows detailed structure of the bin unit, a shaft providing the rotational center of the alignment rod 5 is fixed to the arm 7 at its top end and is fixed to the arm 6 at its bottom end. The arm 7 and the arm 6 are rotatably supported on a pin 21 of the top cover 8 and a unshown pin of a supporting plate 35 of an arm driver station. A sensor plate 23 is fixed on the arm 6, and a sensor 24 is fixed on the frame 3. They are effective to determine the home position of the alignment rod. A sector gear 25 is fixed on the arm 6, and the center of the gear is coincident with the axis of the rotational shaft 22. The sector gear 25 is meshed with an output shaft gear 26 of the driving motor 27 mounted on a supporting plate 35. Rollers 28 and 31 are rotatably supported on shafts 29 and 32 fixed on the frame 3. Roller 30 (cam follower) is rotatably supported on a supporting shaft 34 of a bin 9. A hook 33 is engaged with a spring and is fixed on the frame 3.

Figure 3:
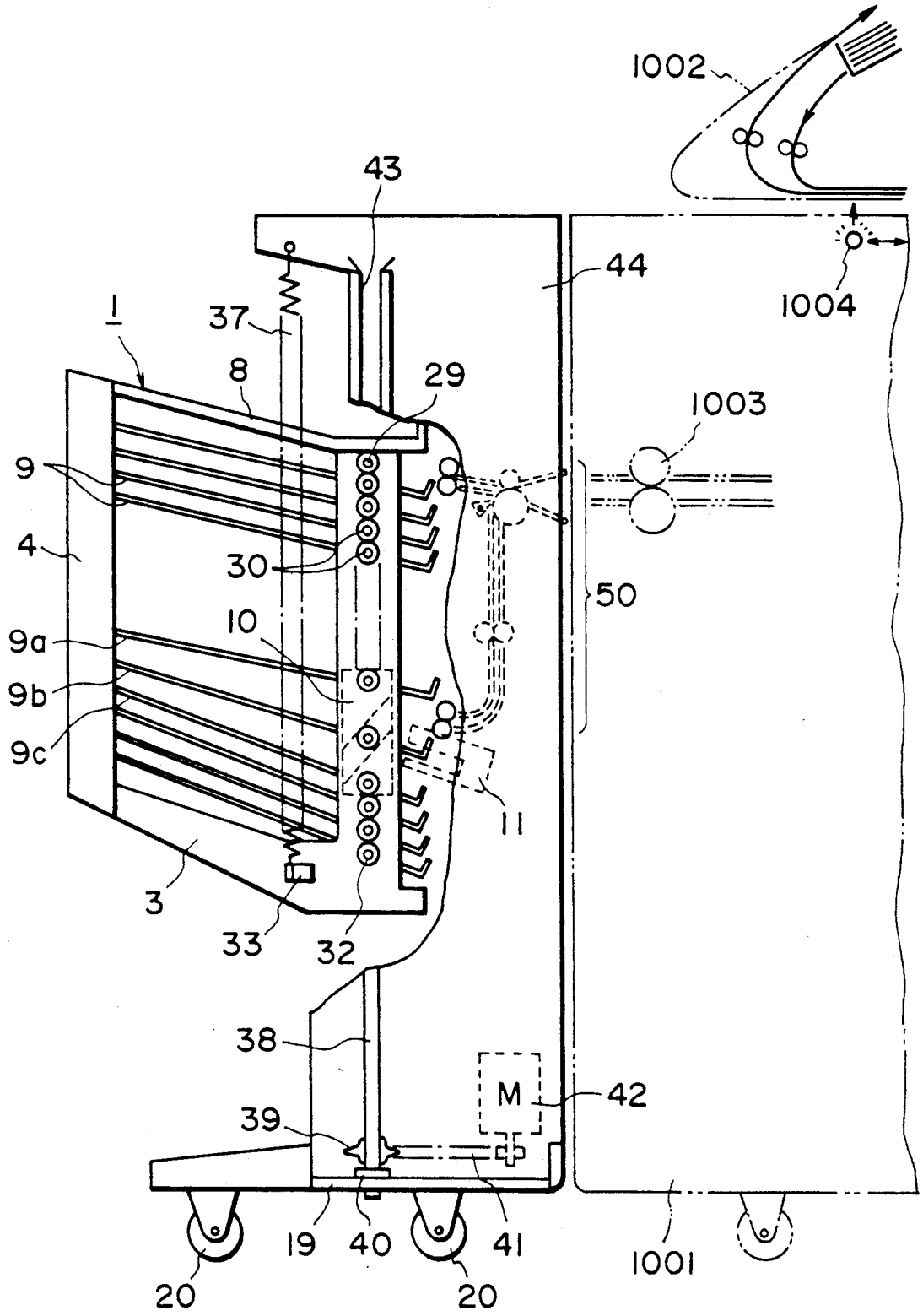
FIG. 3 is a side view of a sorter partly broken.

FIG. 3 shows a structure of the sorter partly broken away. A spring 37 is provided so as to balance the weight of the bin unit 1, and another spring 37 is disposed at a rear side (although it is not shown in the Figure). A rotational shaft 38 of the lead cam 10 is so fixed to the lead cam 10 for not rotating relative to each other. The other end thereof is supported by a bearing 40 for receiving a thrust load. The rotational shaft 38 is provided with a pulley 39 with teeth, mounted thereto, and is rotated by a belt or chain 41 stretched between the driving motor 42 and the pulley 39. Designated by a reference numeral 50 is a sheet conveying section. In the main frame 44, a groove 43 is formed to function as a guide for the rollers 29, 30 and 32 of the bin unit, so that the bin unit 1 is movable along the groove 43 only in a substantially vertical direction. A bin **9*a* is shown as a bin immediately above a bin 9*b* indicated as a bin for receiving a sheet from a sheet discharge outlet, and a bin 9*c* is shown as a bin immediately below the bin 9*b*. By the function of the lead cam 10, the space between the bins 9*a* and 9*b* and the space between the bins 9*a* and 9*b*** are expanded.

Figure 5:
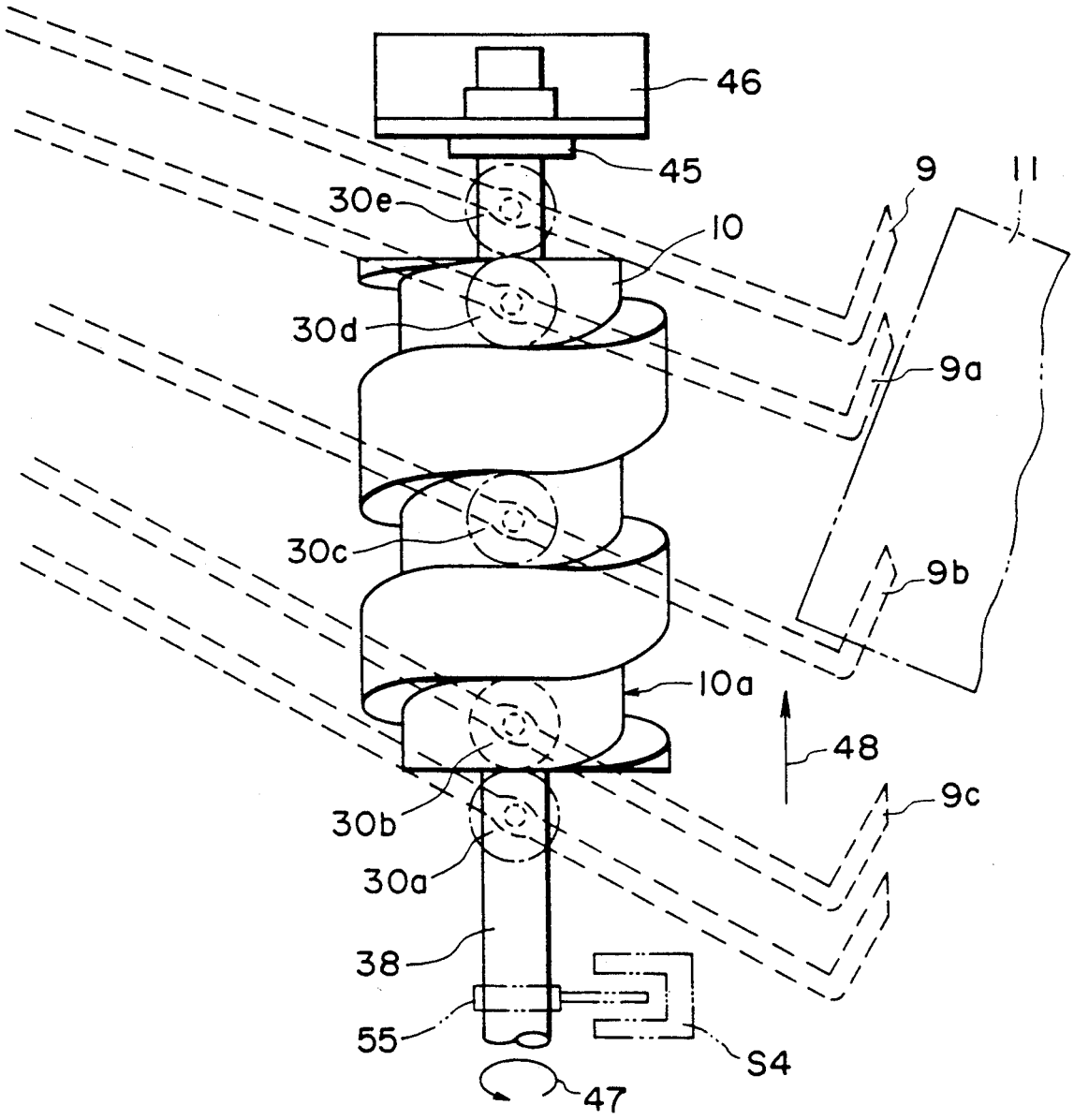
FIG. 5 is a detailed view of a lead cam.

FIG. 5 shows this state in detail. A bearing 45 is provided for the upper end of the rotational shaft 38, and is supported on a supporting **10*a* on its outer periphery. The nature of the cam function provided by the groove 10*a* is such that the follower moves to an intermediate position of the lead cam by one rotation of the lead cam and that it is moved to a position passing therethrough by two rotations. More particularly, when the lead cam 10 rotates through one full turn in a direction indicated by an arrow 47, the roller 30*b* of the bin 9*c* moves in the direction 48 along the groove 10*a* to a position indicated by 30*c*. Through the next one full rotation, it reaches to the position 30*d*. The roller raised to the position 30*d* pushes the roller 30*e* up. The pushing force is transmitted to the frame 3 through the roller 28 so that the frame 3 is increased. As a result, the entirety of unit 1** is raised.

Referring back to FIG. 3, a copying machine 1001 discharges copy sheets to the sorter through the discharging rollers 1003. The copying machine 1001 is equipped with a circulation type document feeder 1002. Ten, for example, pages of originals are stacked on the document feeder face up, and they are fed one by one to the reading position. An exposure lamp 1004 is used to lead the documents. The read originals or documents are recorded on the copy sheet. After completion of the leading, the original is reversed and is stacked again on the document feeder. When the documents ar copied in a sorting mode, one original is read 20 times, for example, so that 20 copy sheets are produced. Those sheets are distributed to the respective bins. The same operation is repeated for the next page original. In this manner, each bin comes to accommodate the copies of 1–10 pages, and 20 sets of such copies are produced.

Figure 6:
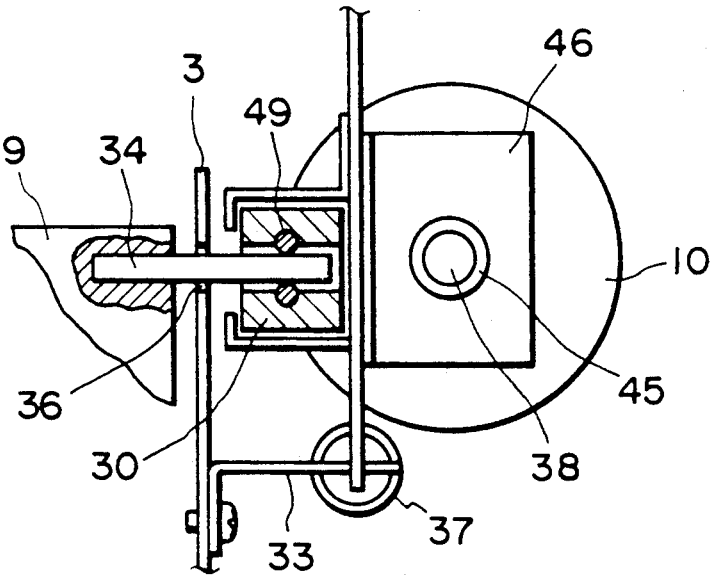
FIG. 6 is a top plan view of the lead cam.

FIG. 6 is a top plan view of the lead cam 10 and the roller 30 when they are engaged. An 0-ring 49 is press-fitted into the periphery of the roller 30 to absorb vibration of the bins upon vertical movement thereof.

Figure 4:
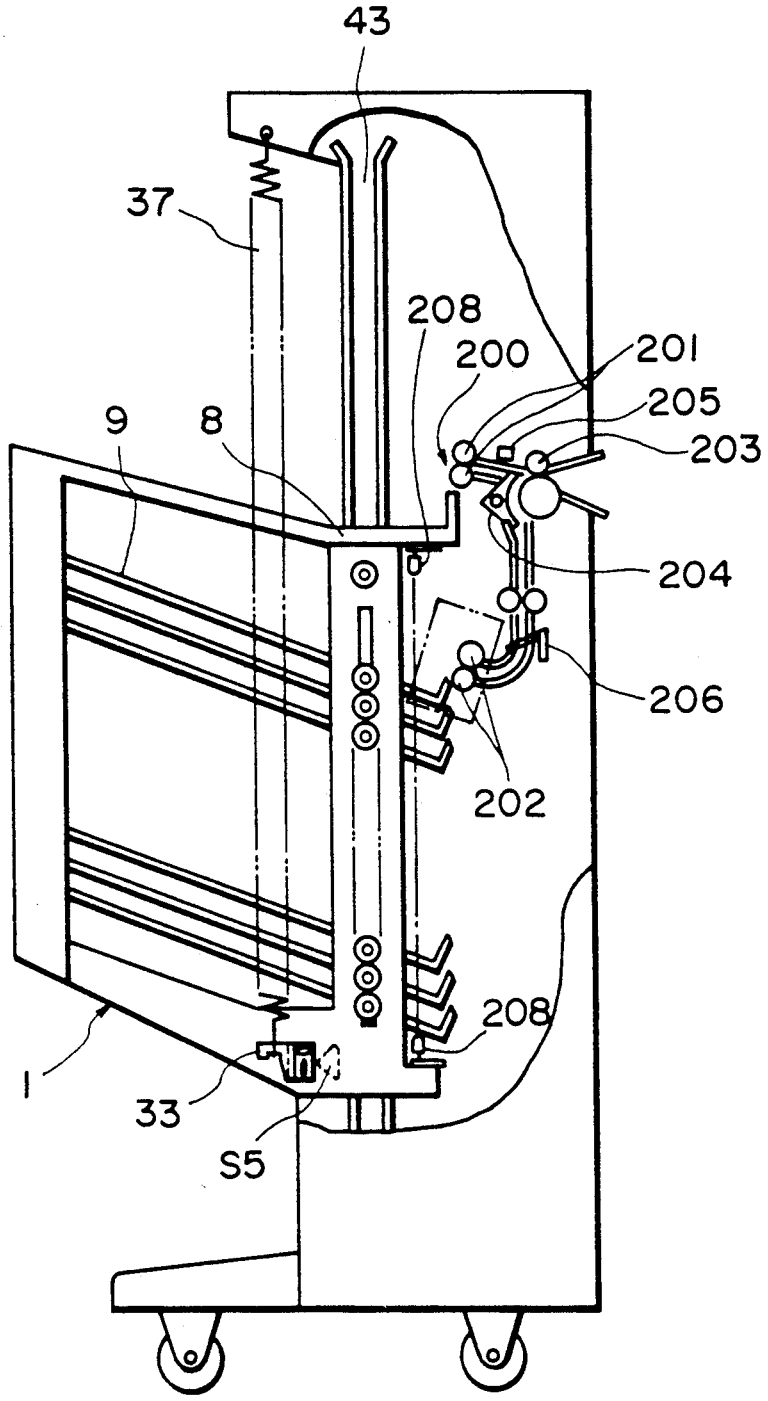
FIG. 4 is a side view partly broken, illustrating the present invention.

FIG. 4 is a sectional view of an apparatus according to an embodiment of the present invention, wherein the bin unit 1 is shown as being located at the home position. The top cover 8 of the bin unit 1 also functions as a non-sort tray for receiving the copy sheets discharged from the non-sort discharging portion 200. Designated by reference numerals 201 and 205 are a pair of non-sort discharging rollers and a sheet sensor for non-sort passage, respectively. At the inlet, there is provided an inlet deflector 204 for selectively directing the sheet discharged from the image forming apparatus to a non-sort discharging side or to a sort discharging side. A pair of sort discharging rollers 202 conveys the sheets to the group of bins 9 in the bin unit 1.

A frame 44 is provided with a bin home position sensor S5 which faces a hook 33 of the bin unit 1 when it is at the lowermost position. By the bin home position sensor S5, the bin unit 1 moved to the home position set to the bottom position is detected.

The lead cam shaft 38 is provided with a flag 55, to which a lead cam sensor S4 is so as to detect one rotation of the lead cam 10 by detecting the flag 55 by the lead cam sensor S4, and so as to detect the stop position of the lead cam 10.

A sensor 208 for detecting the sheet in the bin, in this embodiment, is of a transparent type. Each of the bin trays is provided with a cut-away portion for permitting passage of the sensor light. When the sensor 208 detects a sheet, that is, when a sheet remains in the bin unit, a message is displayed on an operation panel of the image forming apparatus, indicating that a sheet is remaining in the bin unit, or the next copy cycle is prohibited selectively when the operator attempts to take the next copy.

In this embodiment, when, at the start of a copy cycle, a copy sheet in the previous cycle is remaining in the bin unit 1, the copy operation is prohibited. This is done in order to prevent erroneous alignment and stapling of the stacked sheets. As regards the alignment function of the apparatus, if, the size of the copy sheet in the previous cycle is larger than that of the current cycle, the alignment rod 5 is stopped by the size of the sheet in the previous cycle, with the result that the alignment of the copy sheet in the current copy cycle is prevented. However, if the size of the copy sheet in the previous cycle is smaller than the size of the copy sheet in the current cycle, the alignment operation is possible, so that the copy operation may be permitted.

As regard the stapling function, if the copy sheets in the previous copy cycle have been stapled, and if the sheet in the current cycle are stapled at the same position, the double stapling occurs with the result of erroneous stapling operation. Further, the previous sheet and the current sheets are stapled all together.

A sheet sensor 206 is provided in the sort passage. In this embodiment (FIG. 3), when the copy sheets are sorted or sorted and stapled, and thereafter, the sets of sheets are all taken out of the bin unit 9, the sheet detecting sensor 208 in the bin detects absence of sheet. By this, the completion of the copy operation of the current cycle is discriminated, and the bin unit 9 automatically is reset to the home position (FIG. 4), and is prepared for the next copy cycle. As will be understood from FIG. 4, a pair of non sort discharging rollers 201, a pair of sort discharging rollers 202 correspond to the top cover 8, and the bin 9 (the topmost bin), respectively. The copy sheet discharged from the image forming apparatus can be selectively deflected through the pair of inlet rollers 203 only by switching the inlet deflector 204 toward the top cover 8 and the bin 9.

Figure 7:
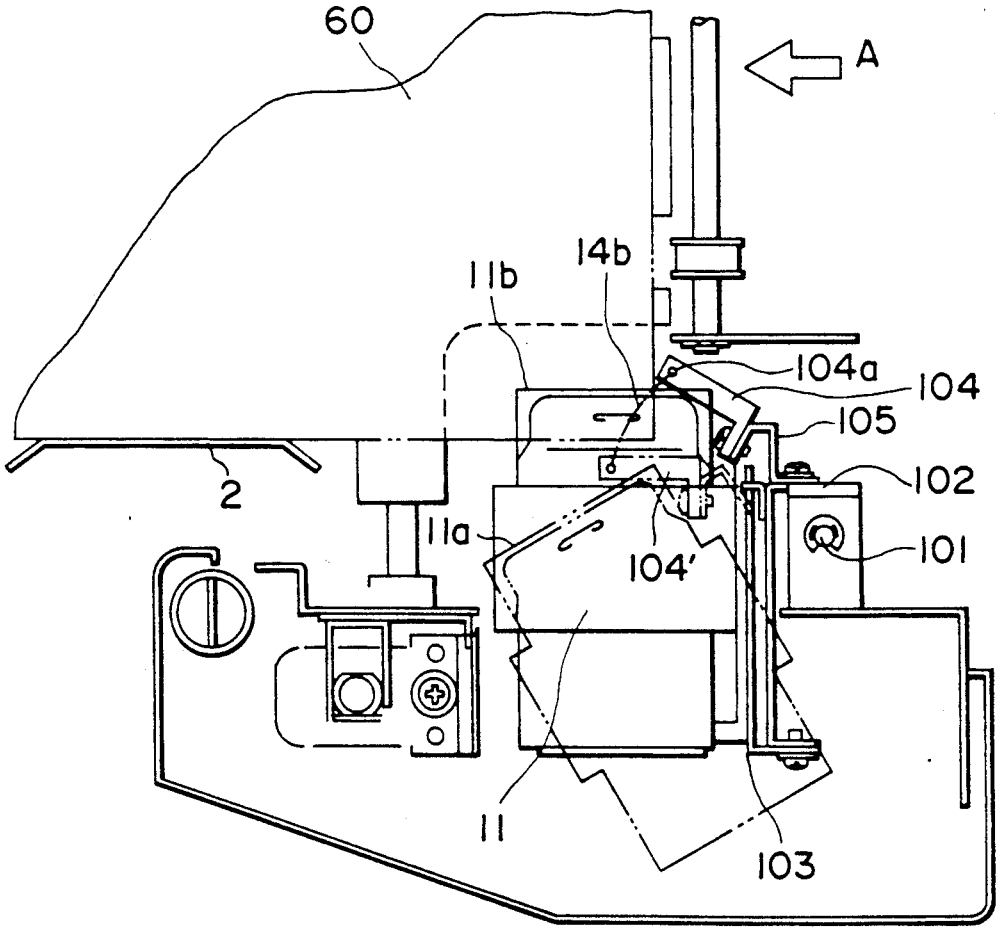
FIG. 7 is a top plan view of a stapling station.
Figure 11:
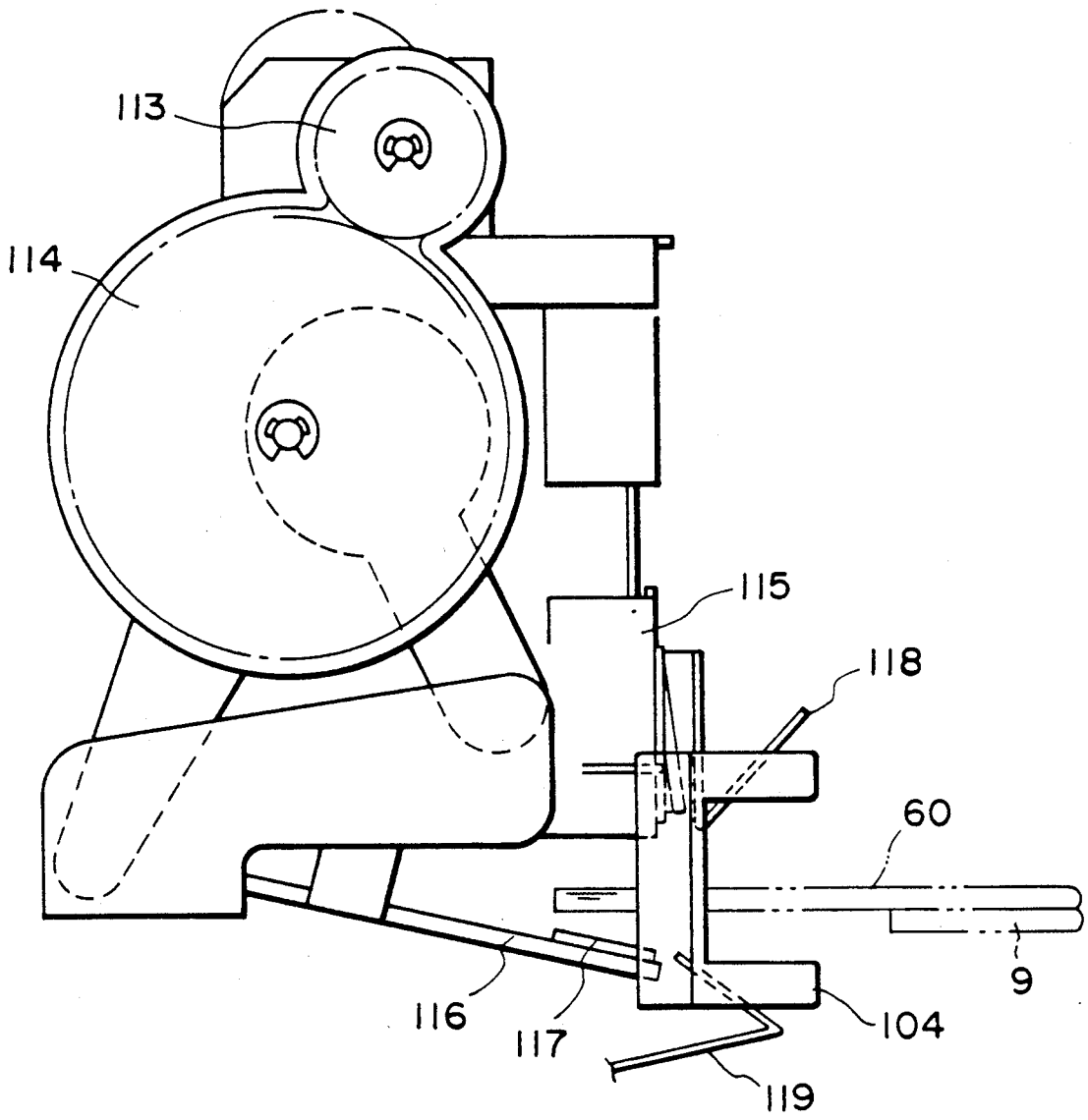
FIG. 11 is a detailed view of a stapling portion.

FIG. 7 is a top plan view of a stapler. The above described stapler unit is designated by a reference numeral 11, and is normally located at a retracted position 11*a* shown by chain lines when the sheet is discharged in the conveying direction indicated by an arrow A in the Figure. With this state, even if the bin shifts up and down, the stapling unit is outside a sheet aligning region and a track of the bin itself. A stapling operation position is designated by a reference 11*b*, this position is reached by the stapler 11 swings about a rotational shaft 101 by the driving from the rink unit which will be described hereinafter. On a swingable base plate 102, a stapler base plate 103 for supporting the stapler 11 is correctly positioned and fixed. The rotational center of the swingable base 102 is in accord with the rotational axis 101. A sheet sensor 104, in this embodiment, is of a transparent type. As shown in FIG. 11, the sensor 104 has a channel shape cross-section so as to detect the sheet by passing the sheet on the bin with the sheet between the legs of the channel. Designated by a reference 104*a* is a sheet sensing position, where the sensing elements are disposed. In this embodiment, a transparent type sensor is taken as a preferable example, the similar effect can be provided by a reflection type sensor.

A sensor mounting base 105 is fixed to the swingable base 102 by screws. The track of the element when the swingable base 102 swings is designated by a reference 104*b*, and as will be understood, it passes by an end of the sheet 60 on the bin. In this embodiment, when the stapler moves from the position 11*a* to the position 11*b*, the sensor element 104*a* has already crossed sheet, but it is possible that the sensing is continued at the position 11*b* (the element is above the sheet even at the stapling position), and this is accomplished if the electrical control and mechanical arrangement of the sensor are properly determined.

A reference numeral 104 designates a position of the sheet sensor 104 when the stapler 11 reaches the retracted position 11*a*, and when it is positioned this way, the sensor 104 as well as the stapler 11 is placed outside the sheet alignment region.

Figure 8:
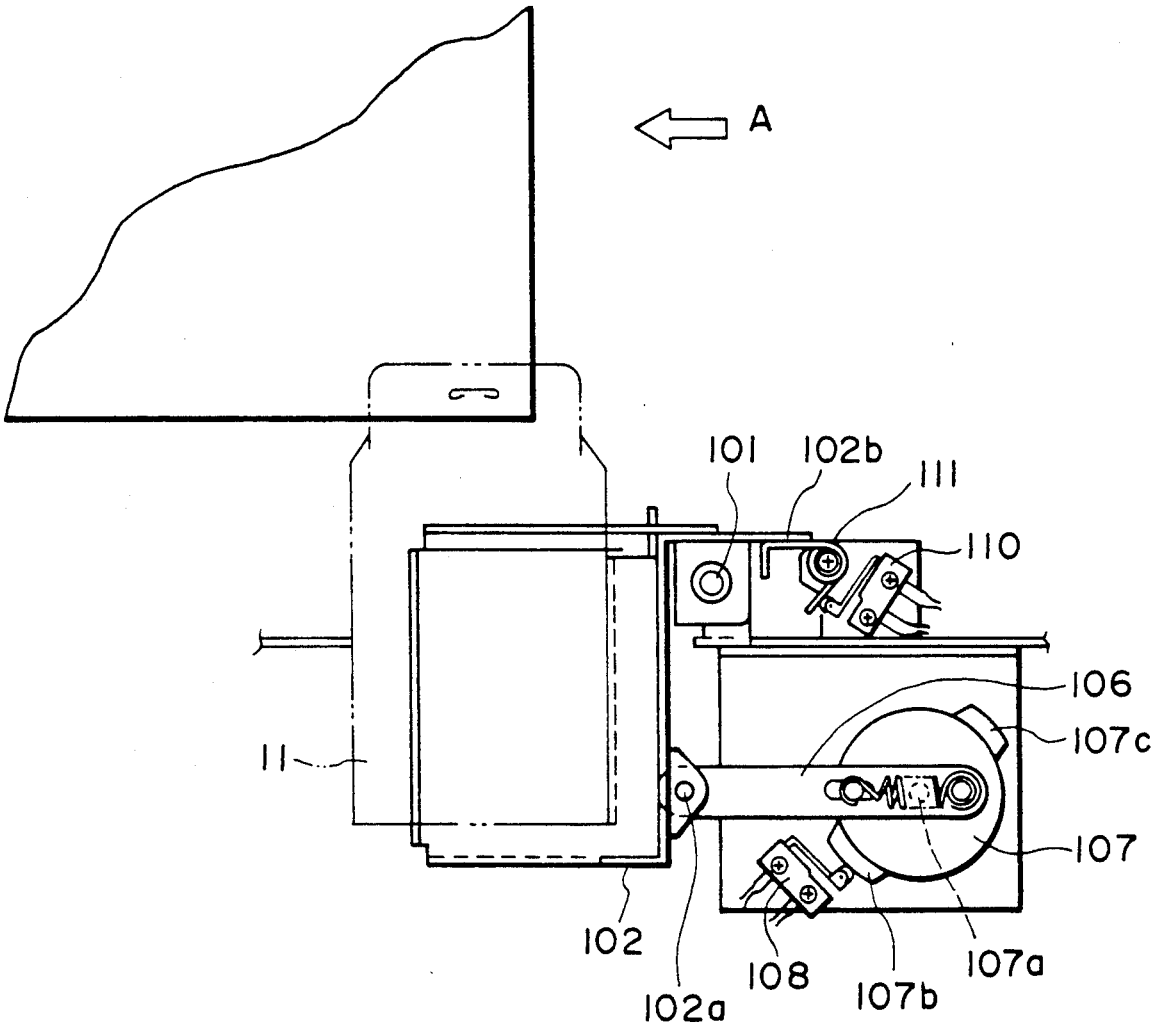
FIG. 8 is a top plan view of a mechanism for swinging movement of the stapler.
Figure 9:
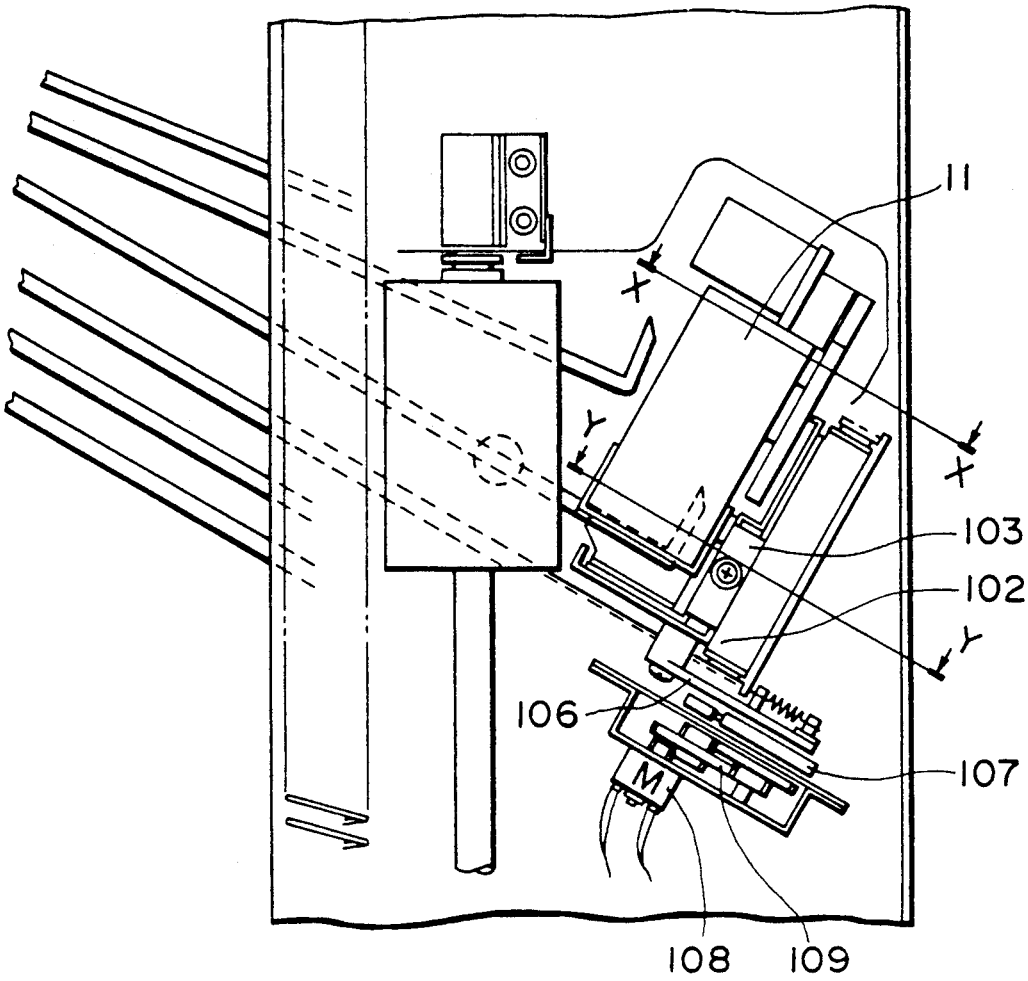
FIG. 9 is a front view of the stapler station.

Referring to FIG. 8, a top plan view of the stapler unit is shown to illustrate the swinging mechanism. The stapler base 103 for supporting the stapler unit 11 is detachably mountable and positionable on the swingable base 102, as described hereinbefore. An operational point of the swingable base 102 is designated by a reference 102*a*, at which it is rotatably supported to the link arm 106. FIG. 9 is a front view of a stapler unit driving unit, which will be described together with FIGS. 8 and 9. A link disk 107 has a rotational center 107*a*. The link disk 107 receives driving force from the motor 108 shown in FIG. 9 through a reduction unit constituted by gears. The disk 107 detects a cam position by a positioning microswitch 108 having two cam surfaces 107*b* and 107*c* at the proper positions on the circumference. More particularly, the stapler 11 is stopped and positioned at either of the stapling position 11*b* and the retracted position 11*a* (in FIG. 8, reference numeral 107*b* depicts the stapling position 11*b*). A microswitch 110 serves to detect the stapling position. When an end 102*b* of the swingable base which is swingable integrally with the stapler depresses an actuator 111 made of plastic resin or the like, the other end of the actuator 111 is contacted to the microswitch 110 so that it is recognized that the stapler 11 is at the stapling position 11*b*. That is, by the combination of the position detecting microswitch 110 and a positioning microswitch 108, it is recognized whether the stapler 11 is positioned at the stapling position 11*a* or the retracted position 11*b*.

Figure 10:
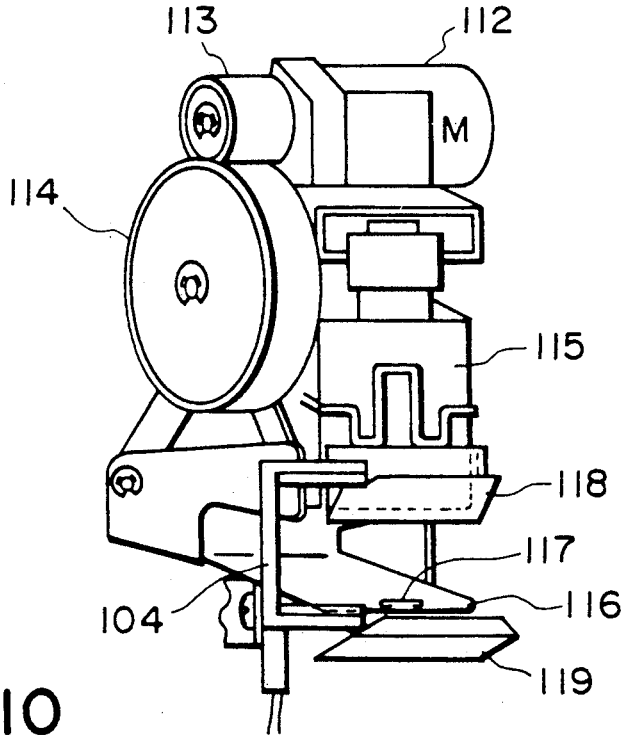
FIG. 10 is a perspective view of a stapler.

FIG. 10 shows a stapler used with an embodiment of the present invention. The driving force of the driving motor 112 is transmitted by the gears 113 and 114, and the rotation of the gear 114 rotates a directly connected link unit, so that the upper unit 115 and the lower unit 116 are contacted together to bend a staple. The staple is bent at a position indicated by a staple mark (117) in FIG. 10.

FIG. 11 is a side view of a stapler, wherein the position 117 is shown as being between the upper unit 115 and the lower unit 116. Therefore, the sheets 60 to be stapled have to be between the upper unit 115 and the lower unit 116, as shown in FIG. 10. In this structure, the stapler is swung to correctly position the staple 117 at an end of the sheets which have been aligned and correctly positioned.

The operation will be described.

The operation from the sheet discharge from the image forming apparatus to the reception of the sheets by the bins is the same as in a conventional sorter, and therefore, the description thereof is omitted for simplicity. The description will be made particularly as to the operations after the sheets have been discharged to the bins before they are aligned and stapled.

Figure 12:
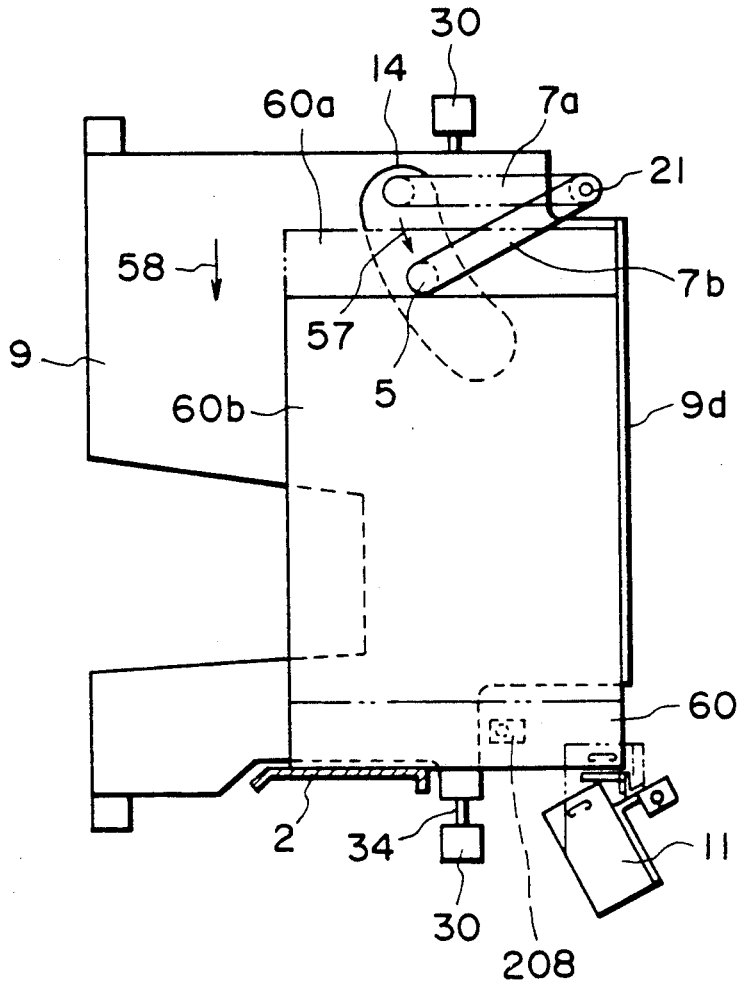
FIG. 12 is a top plan view of a bin stapler.

In FIG. 12, the sheets 60*a* (indicated by chain lines) immediately after the sheets are discharged to the tray are pushed by the alignment rod in the direction indicated by an arrow 58. The movement of the alignment rod is provided by the arm 7*a* placed beforehand at its home position rotates about a rotational center 21 in the direction of arrow 57 the driving motor 27 for the alignment rod 5 is, for example, of a pulse motor type, in which by applying to it a pulse signal determined in accordance with the size of the sheet, the sheet moves until it abuts an alignment reference member 2 (solid line position 60*b*). Since the bin 9 is inclined downwardly toward the sheet inlet side, and therefore, the sheet discharged moves by its own weight until it abuts a rear end stopper 9*d*. Thereafter, it is movable in the direction 58 along the stopper 9*d*. To prepare for the next sheet discharge, the arm 7*b* is returned to its home position 7*a*. By repeating the above operations, plural sheets in one bin are abutted to the alignment reference member 2 at its lateral edge and is abutted to the rear end stopper 9*d* at its rear end, so that the sheets are aligned. Since the alignment rod 5 is extended through all of the bins, the same operation also aligns the sheets on the other bins. An automatic stapling is selectable. If the stapling mode is not selected, the operation is completed at this point. This also applies to the case where the sorter is not equipped with a stapler. As shown in FIG. 12, the bin sheet sensor 208 is disposed corresponding to all of the cut-away portions of the bins, so that presence of even one sheet on any of the bins is detected.

When the stapling mode is selected, the swinging motor 108 drives in response to a stapling instruction signal produced from the main assembly, so that the stapler 11 positioned on the swinging unit swings. A sheet sensor 104 detects whether or not a sheet is present on a bin between the retracted position 11*a* to the stapling position 11*b*. The staple driving motor 112 is energized only when the sheet is present there, to staple the sheets. The stapler is equipped with a one rotation sensor shown, and when the one rotation (one stapling operation) is detected, the swinging motor 108 is actuated again to return the stapler to the retracted position 11*a*. The retraction of the stapler is recognized by the microswitches 108 and 110, as described hereinbefore. In response to the signal, in the case where plural bins accommodate the sheets, the bins shift, and the above operations are repeated to sequentially staple the sets of sheet. For example, when a certain bin or bins are emptied before the stapling, the sheets are not detected for the bin or bins, the stapler only swings forwardly and backwardly only, and the stapling operation is not performed.

In this embodiment, the stapling operation is started in response to a copy completion signal after the sheets are stacked on all of the necessary bins. However, the stapling operation can be started as soon as a last page is discharged to a bin, and this is sequentially repeated.

Figure 13:
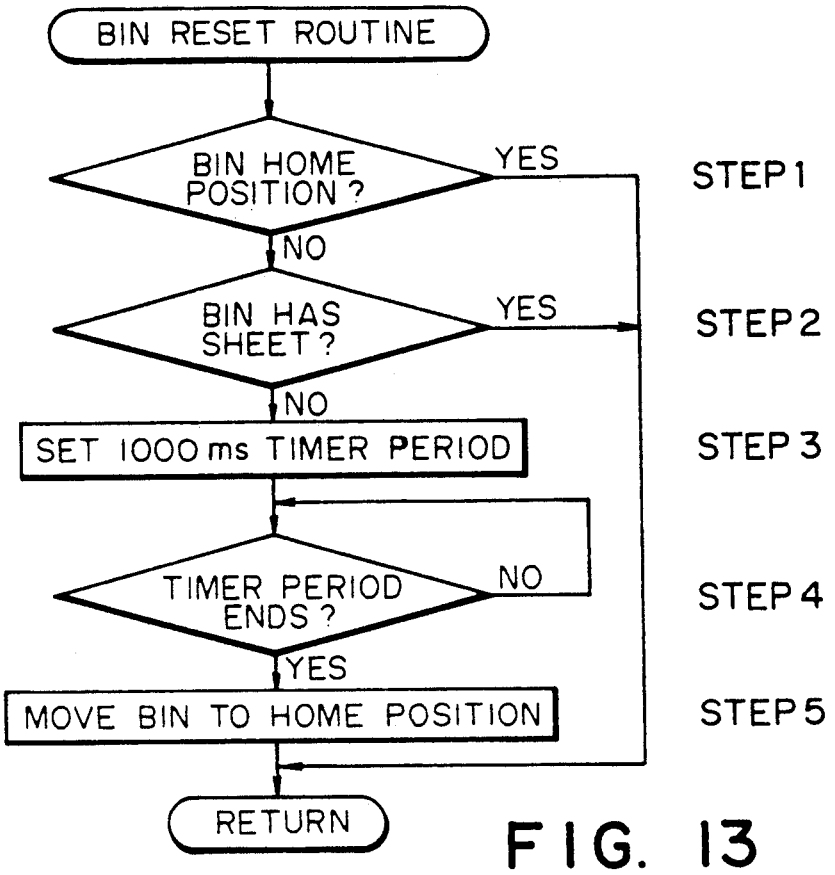
FIG. 13 is a flow chart of the control system according to an embodiment of the present invention.

Referring to FIG. 13, a process of resetting the bin unit to the home position will be described. FIG. 13 is a flow chart of a subroutine for returning the bins to the home position when the sheets are taken out of the bins.

First, the discrimination is made as to whether the bin is at the home position or not (step 1). If so, the returning operation is not necessary, so that the sequence goes out of this subroutine.

If the bin is not at the home position, the discrimination is further made as to whether or not a sheet is remaining in a bin (step 2).

If not, the sequence goes to step 3 to return the bin to the home position. At step 3, it is dangerous if the bin is shifted immediately after the operator takes the sheets out. In consideration of this, a 1000 msec timer is used so as to assure the safety and so as not to threaten the operator.

After the timer period passes set at step 3 (step 4), the bin is returned to the home position (step 5). Then, the sequence goes out of the bin resetting routine.

As regards the timer period, it may be 1, 2, 3 or more, and can be determined so as to be matched with the total system so that the operator can use the system most comfortably with respect to the downward or upward movement of the bins to the home position.

As regards the speed of the upward or downward movement, it is possible that the speed is lower than the speed of the upward or downward step-by-step movement during the normal sorting mode operation. If this is done, the noise is reduced. This can be accomplished by controlling the motor to reduce the speed of the cam 10 rotation. After the copying operation is completed, the operator takes all the sheets from the bins. Then, the bins automatically return to the home position at a low speed so as to be prepared for reception of the next copy signal. The operator is not threatened, as compared with the case where the bins are suddenly moved up or down.

The rotational speed of the cam 10 may be increased or decreased by changing the rotational speed of the motor by electric control, or otherwise, it can be mechanically controlled by variable ratio gear trains between the motor and the cam 10.

Figure 14:
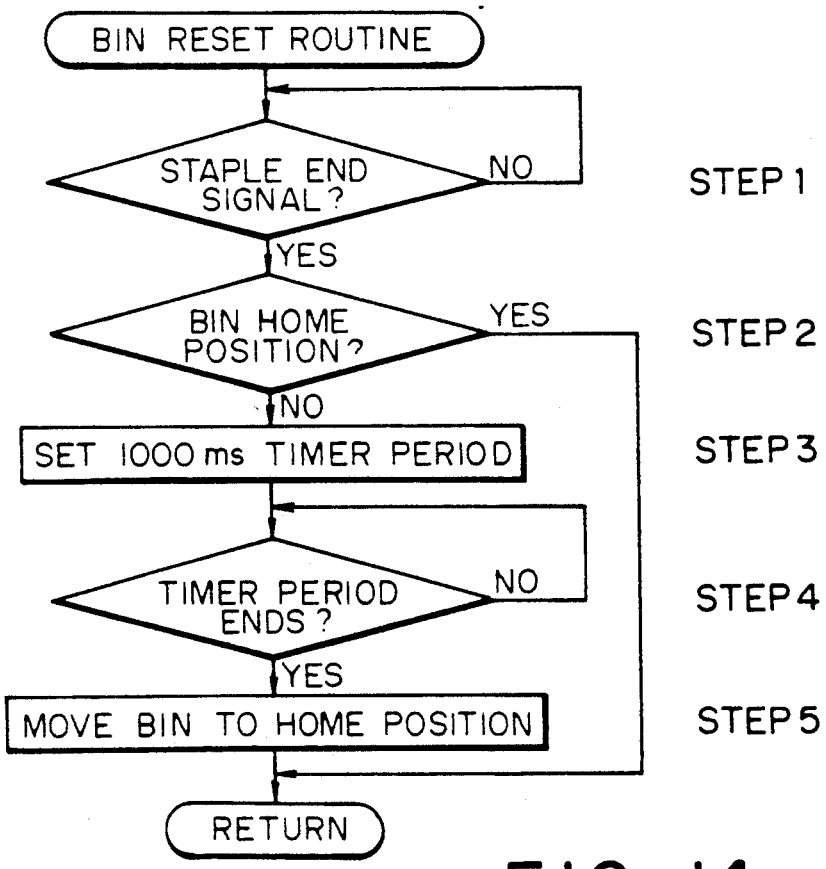
FIG. 14 is a flow chart of a control system according to another embodiment of the present invention.

Another embodiment of the present invention will be described. In the previous embodiment, the bins are automatically returned to the home position when the bin unit is not at the home position when the bin sheet detecting sensor detects that there is no sheet on the trays. However, it is possible that when the bin unit is not at the home position upon stapler completion signal, the bins are automatically returned to the home position simultaneously with stapler completion signal generated (FIG. 14). Further, it is also possible that when the stapling mode is not selected, the bins are automatically returned to the home position simultaneously with copy completion signal produced or distribution completion signal (passage of the last sheet by the element S206). In this case, the resetting operation of the bin unit is performed at a lower speed in the manner described above.

Figure 15:
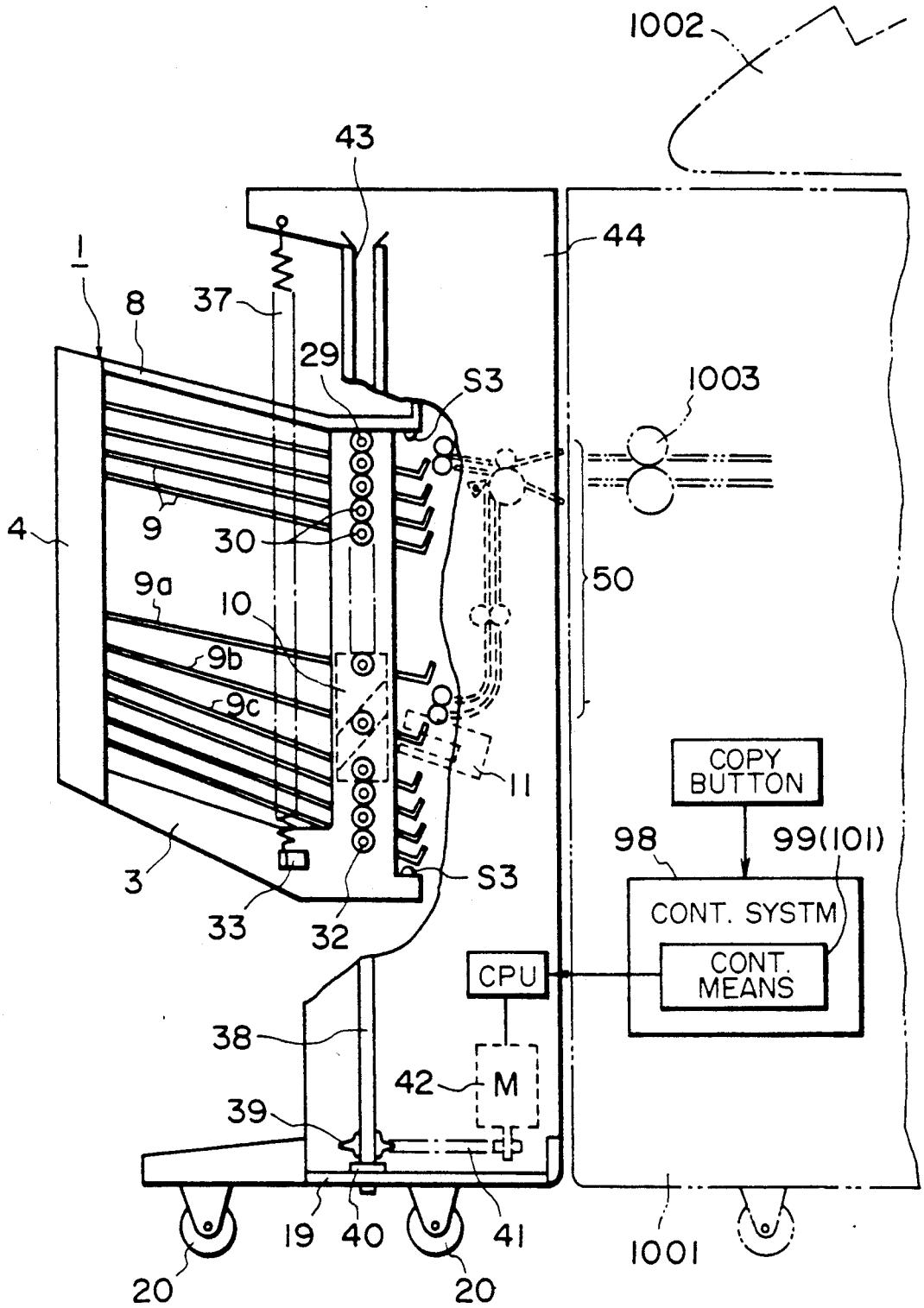
FIG. 15 is a sectional view of another embodiment of a sorter.
Figure 16:
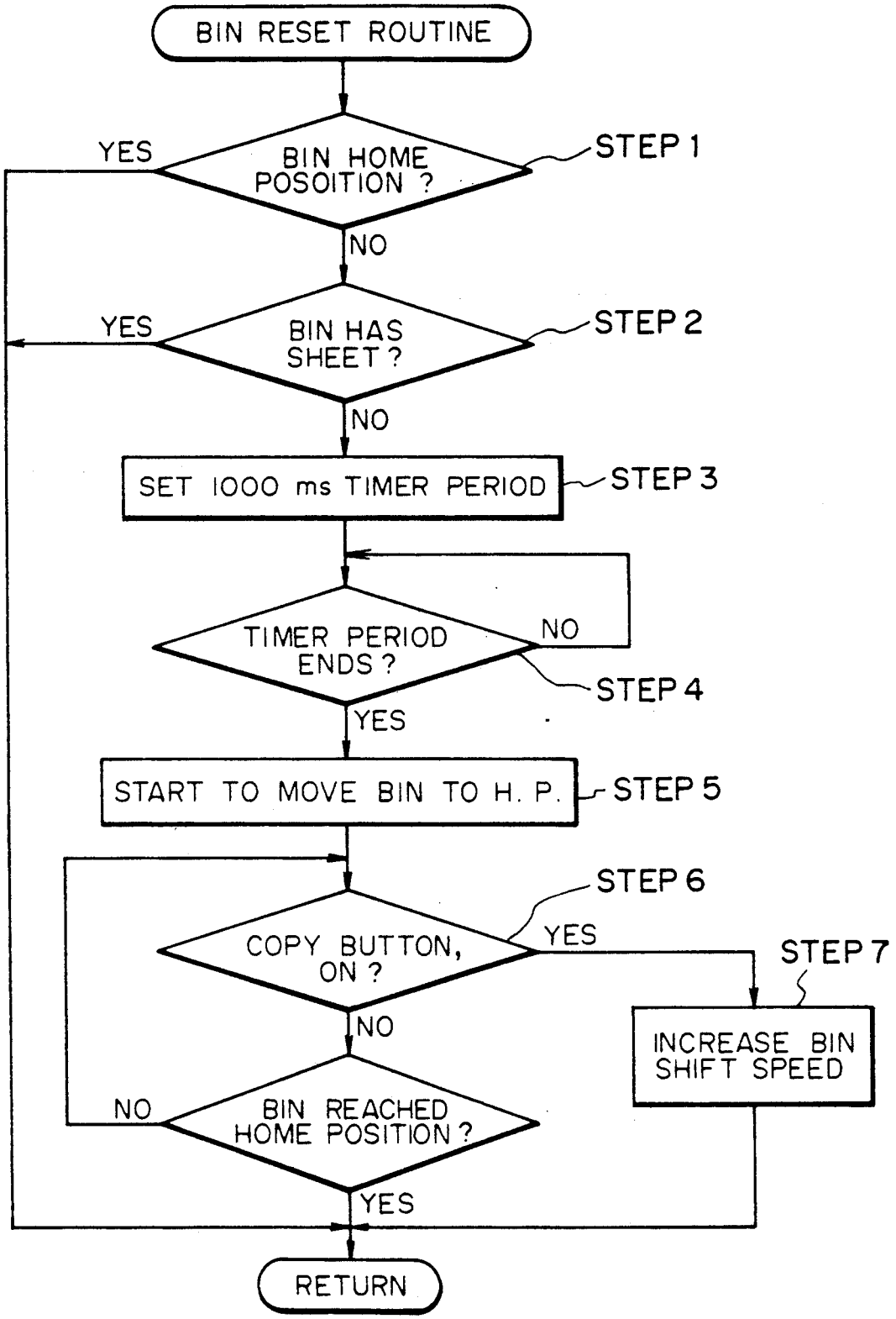
FIG. 16 is a flow chart of a control system for the apparatus of FIG. 15 according to an embodiment of the present invention.
Figure 17:
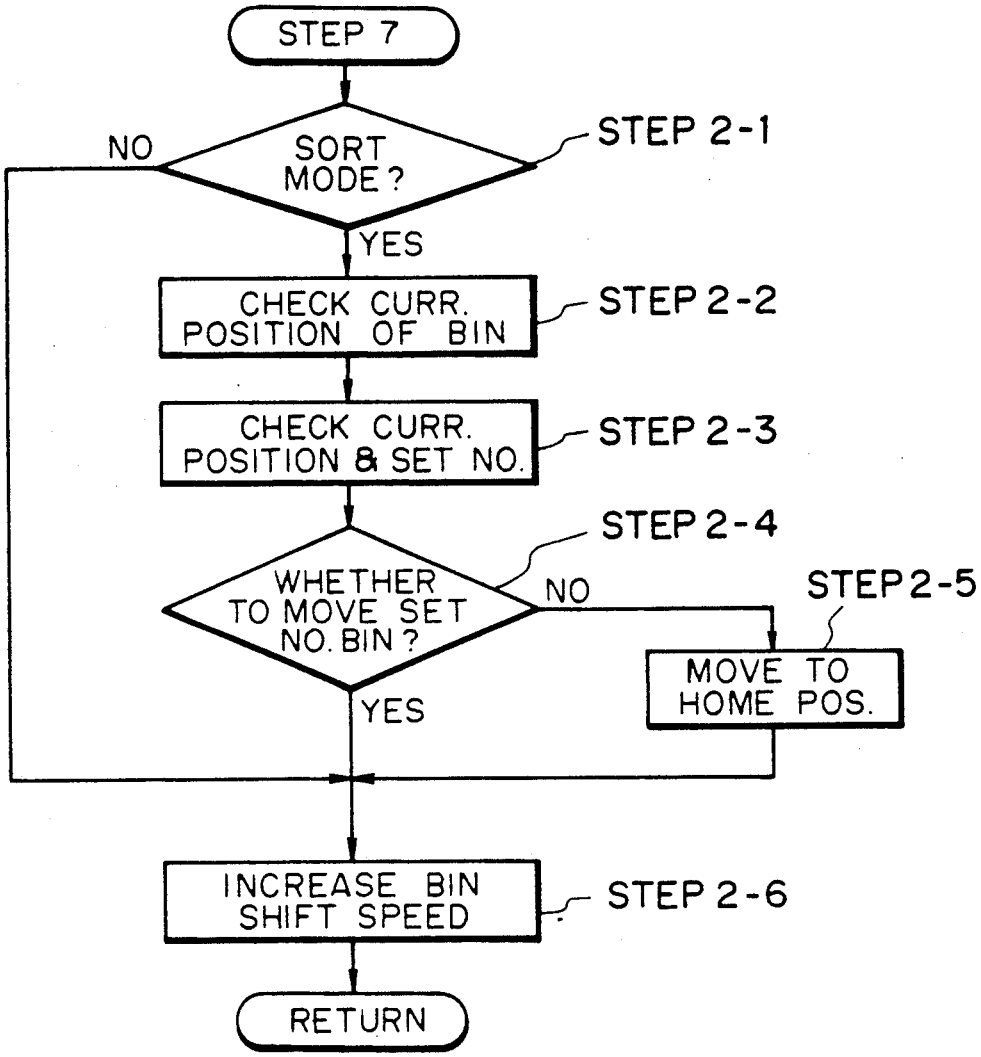
FIG. 17 is a flow chart of a control system for the apparatus of FIG. 15 according to a further embodiment of the present invention.
Figure 18:
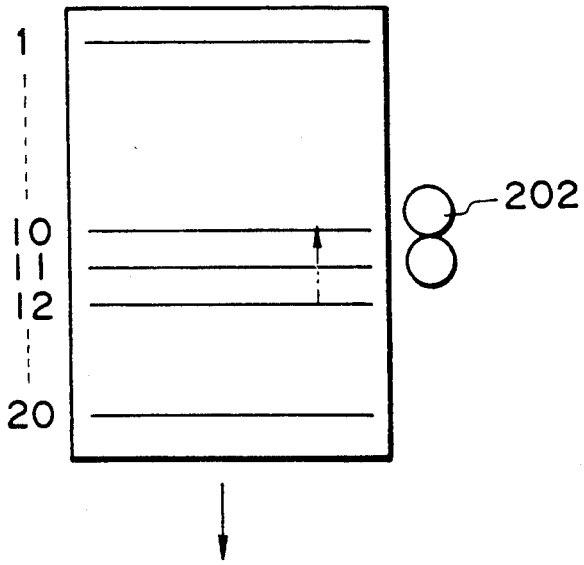
FIG. 18 illustrates an operation of FIG. 15 apparatus with the control system of FIG. 17.

Referring to FIGS. 15–17, a further embodiment will be described wherein the resetting speed is increased. In this embodiment, the same reference numerals as in FIGS. 1–12 are assigned to the element having the corresponding functions, and the detailed description is omitted for simplicity.

A control device 98 for controlling the operation of the sorter is provided with control means 99 including a program for increasing the resetting speed of the bin unit 1 to the home position. The control means 99, as shown in FIG. 15, controls the bin unit driving motor 42 so that the resetting speed of the bin unit 1 is increased when the next operation starting signal is inputted by, for example, copy button is depressed during the movement of the bin unit 1 to the home position after completion of the previous operation.

Referring to FIG. 16 which is a flow chart, the operation of the apparatus according to this embodiment will be described.

The sheets P are sequentially distributed to each of the bins 9 of the bin unit 1. Upon completion of the sheet sorting or distributing operation, the sheets P in the bins are taken out by the operator, in response to which the bin unit resetting operation to the home position is started. First, the description is made as to whether or not the bin unit 1 is at the home position (step 1). If not, the discrimination is further made as to whether or not a sheet remains on a bin (step 2). If not, the operation for returning the bin unit to the home position is started. In this case, if the bin unit movement starts immediately after the operator takes the sheets P out of the bins, it is dangerous. In order to avoid the danger, the 1000 msec timer is used (step 3) so as not to threaten the operator. When the timer period passes (step 4), the movement of the bin unit to the home position is started (step 5). If the copy button or the like is depressed during the resetting movement of the bin unit, and a signal instructing the start of the next operation is inputted (step 6), during the resetting movement of the bin unit, the movement speed of the bin unit to the home position is increased (step 7) by, for example, increasing the rotational speed of the driving motor 42 for the bin unit (for example, normal state (the state during the sorting operation) is restored from a reduced state) (step 7). Thus, the bin unit is reset to the home position for a reduced period of time. By this, the bin unit can return the home position more quickly, and therefore, the start of the next operation can be started quickly, thus increasing the operational efficiency.

The present invention is not limited to the above described embodiment, but the steps 6 and 7 in FIG. 16 may be inserted between step 2 and step 3. More particularly, when the copy button is depressed immediately before the resetting movement, the bins are moved to the lower home position at a high speed from the beginning. This can be incorporated in such a system wherein the timer is used to count the time after the completion of the sorting operation, and the bins start to return at a low speed after the timer period passes.

The foregoing embodiment has been described as starting the sorting operation with the topmost bin, and to enable this, the bin unit is reset to the home position. But the present invention is not limited to this. For example, the bin unit may be reset to a home position where a predetermined bin is faced to the sort discharging outlet 202 (FIG. 17) so that the sheet sorting can be started with a predetermined one of the bins of the bin unit.

Referring to FIG. 17, this embodiment will be described in detail. In this embodiment, a programmed control means 101 resets the bin unit to such a position wherein n-th bin is faced to a sort discharge outlet 2, where "n" corresponds to a number of sets of the sheets to be sorted. For example, the number of sets of the sheets to be sorted is 3, the third bin is faced to the sort discharging outlet 202 when the bin unit is reset.

The operation will be described in conjunction with FIG. 17.

If the copy button of the copying machine is depressed during the returning movement of the bin unit to the home position, the description is made as to whether or not the sorting mode is selected (step 2-1). If so, the current address is confirmed (step 2-2). Then, the discrimination is made as to which is quicker, to go to the home position or to go to the "n-th" position (step 2-3, step 2-4). If the home position is quicker, the bin unit is moved to the home position (step 2-5). If the n-th bin is quicker, the bin unit is moved to such a position where the n-th bin is faced to the sort sheet discharging outlet 16 (step 2-6).

For example, when the tenth bin is faced to the sort discharge outlet 202 during the bin unit lowering to the home position from a position where the bottommost bin (20th) is faced to the sort discharge sheet outlet 202, the copy button is depressed with the number of sorted sheets of 12. The bin tray is reversed to move upwardly at a higher speed from the position where the tenth bin is faced to the sheet discharge outlet 202 to the position where 12th bin is faced thereto, and the bin tray is stopped at the position. The sheets are received while being sorted from the 12th bin, and the bin unit is moved downwardly. By this, the resetting period of the bin unit is further reduced to permit the quicker start of the next operation.

While the invention has been described with reference to the structures disclosed herein, it is not confined to the details set forth and this application is intended to cover such modifications or changes as may come within the purposes of the improvements or the scope of the following claims.

What is claimed is:

1. A method for controlling a sheet sorter, wherein plural bins are sequentially moved to be faced to a sheet material inlet to sort the sheet materials into the bins, said method comprising the steps of:

permitting sorting operation; and starting resetting movement to rest the plural bins after all the sheet materials which have been sorted are taken out of the bins, wherein the bins are moved by the resetting movement to a nearest position from among first and home positions, wherein the first position is a position in which the inlet is faced to a one of the bins to be last used in a next cycle operation.

2. A method for controlling a sheet sorter wherein plural bins are sequentially moved to be faced to a sheet material inlet to sort the sheet materials into the bins, said method comprising the steps of:

permitting sorting operation; and starting resetting movement to reset the plural bins after all the sheet materials which have been sorted are taken out of the bins, wherein the bins are moved, during the resetting movement, at a speed lower than that during the sorting operation.

3. A method for controlling a sheet sorter wherein plural bins are sequentially moved to be faced to a sheet material inlet to sort the sheet materials into the bins, said method comprising the steps of:

permitting sorting operation;

starting resetting movement to rest the plural bins at a speed lower than that during the sorting operation after the sheet materials which have been sorted are taken out of the bins; and increasing a speed of the resetting movement of the plural bins when a next cycle starting signal is inputted during the resetting movement.

4. A method according to claim 3, wherein the next cycle starting signal is produced by a copy button of a copying apparatus which is used with the sheet sorter.

5. A method according to claim 3, wherein the increased speed is substantially the same as the speed during the sorting operation.

6. A method according to claim 3, wherein the bins are returned to a home position by the resetting movement.

7. A method according to claim 3, wherein the bins are moved by the resetting movement to a nearest one position from among first and home positions, wherein the first position is a position in which the inlet is faced to a one of the bins to be last used in a next cycle operation.

8. A method for controlling a sheet sorter wherein plural bins are sequentially moved to be faced to a sheet material inlet to sort the sheet materials into the bins, said method comprising the steps of:

permitting sorting operation; and starting resetting movement to rest the plural bins at a speed lower than that during the sorting operation.

9. A method according to claim 8, wherein the bins are returned to a home position by the resetting movement.

10. A method according to claim 8, wherein the bins are moved by the resetting movement to nearest one position from among the first and home positions, wherein the first position is a position in which the inlet is faced to a one of the bins to be last used in a next cycle operation.

11. A method according to claim 8, further comprising the step of stapling the sheets which have been sorted, wherein completion of the sorting operation is detected by detection of a staple completion signal.

12. A method according to claim 11, wherein after the staple completion signal, the resetting movement is started after a timer period is counted up.

13. A method for controlling a sheet sorter wherein plural bins are sequentially moved to be faced to a sheet material inlet to sort the sheet materials into the bins, said method comprising the steps of:

permitting sorting operation; and starting resetting movement to reset the plural bins at a speed lower than that during the sorting operation, wherein the speed of the resetting movement is increased when a next cycle starting signal is inputted during the resetting movement.

14. A method according to claim 13, wherein the increased speed is substantially the same as that during the sorting operation.

15. A method for controlling an image forming apparatus provided with a sheet sorter wherein plural bins are sequentially moved to be faced to a sheet material inlet to sort the sheet materials having images formed by the image forming apparatus, into the bins, the method comprising the steps of:

permitting sorting operation;

starting resetting movement to rest the plural bins after all the sheet materials which have been sorted are taken out of the bins; and increasing a speed of the resetting movement of the plural bins when a next cycle starting signal is inputted during the resetting movement.

16. A method for controlling an image forming apparatus provided with a sheet sorter wherein plural bins are sequentially moved to be faced to a sheet material inlet to sort the sheet material having images formed by the image forming apparatus, into the bins, comprising:

permitting sorting operation; and starting resetting movement to rest the plural bins at a speed lower than that during the sorting operation.

17. A method for controlling a sheet sorter wherein plural bins are sequentially moved to be faced to a sheet material inlet to sort the sheet materials into the bins, the method comprising the steps of:

permitting sorting operation;

starting resetting movement to reset the plural bins at a speed lower than that during the sorting operation, wherein the speed of the resetting movement is raised to an increased speed when a next cycle starting signal is inputted during the resetting movement; and stapling the sheets which have been sorted, wherein completion of the sorting operation is detected by detection of a staple completion signal, and wherein, after detection of the staple completion signal, the resetting movement is started after a timer period is counted up.

18. A method according to claim 17, wherein the increased speed is substantially the same as that during the sorting operation.

19. A method for controlling an image forming apparatus provided with a sheet sorter, wherein plural bins are sequentially moved to be faced to a sheet material inlet to sort the sheet materials, having images formed by the image forming apparatus, into the bins, the method comprising the steps of:

permitting sorting operation; and starting resetting movement to reset the plural bins after all the sheet materials which have been sorted are taken out of the bins, wherein the bins are moved by the resetting movement to a nearest position from among first and home positions, wherein the first position is a position in which the inlet is faced to a one of the bins to be last used in a next cycle operation.

* * * * *

UNITED STATES PATENT AND TRADEMARK OFFICE

CERTIFICATE OF CORRECTION

PATENT NO. : 5,035,412

DATED : July 30, 1991

INVENTOR(S) : Hiroi, et al.

It is certified that error appears in the above-identified patent and that said Letters Patent is hereby corrected as shown below:

COLUMN 3,

Line 52, "supporting 10a" should read --supporting plate 46. The lead cam 10 is provided with a groove 10a--.

Signed and Sealed this

Twenty-sixth Day of January, 1993

*Attest:*

STEPHEN G. KUNIN

*Attesting Officer*

*Acting Commissioner of Patents and Trademarks*